US008424721B2

(12) United States Patent
Krishnan et al.

(10) Patent No.: US 8,424,721 B2
(45) Date of Patent: Apr. 23, 2013

(54) DEVICE AND METHOD FOR MONITORING CONSUMER TEST COMPLIANCE

(75) Inventors: Srinivasan Krishnan, Stamford, CT (US); Amir Ashkenazi, Hamden, CT (US); Jomer Lalo Delacruz, Naugatuck, CT (US); Marc Gregory Ticzon, Stratford, CT (US); Jonathan Garrett Winn, Fairfield, CT (US); Jean-Marc Dessirier, Stratford, CT (US); Tobias Christian Trumpp, Milford, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 1076 days.

(21) Appl. No.: 12/365,467

(22) Filed: Feb. 4, 2009

(65) Prior Publication Data

US 2010/0085194 A1 Apr. 8, 2010

Related U.S. Application Data

(60) Provisional application No. 61/102,881, filed on Oct. 6, 2008.

(51) Int. Cl.
*B67D 7/24* (2010.01)

(52) U.S. Cl.
USPC ..... 222/30; 222/37; 222/71; 340/573.1

(58) Field of Classification Search ..... 222/640, 222/641, 30, 36, 37, 23, 71; 340/573.1, 516; 211/59.2
See application file for complete search history.

(56) References Cited

U.S. PATENT DOCUMENTS

| | | | | |
|---|---|---|---|---|
| 2,566,669 | A | 9/1951 | Lesnick | |
| 3,170,597 | A * | 2/1965 | Reichenberger | 222/36 |
| 4,034,757 | A * | 7/1977 | Glover | 604/404 |
| 4,278,186 | A | 7/1981 | Williamson | |
| 4,736,871 | A * | 4/1988 | Luciani et al. | 222/25 |

(Continued)

FOREIGN PATENT DOCUMENTS

| | | |
|---|---|---|
| WO | 2008/058817 A1 | 5/2008 |
| WO | 2008/062146 A1 | 5/2008 |

OTHER PUBLICATIONS

International Search Report PCT/EP2009/062314.
PCT Written Opinion—PCT/EP2009/062314.

*Primary Examiner* — Kevin P Shaver
*Assistant Examiner* — Robert Nichols, II
(74) *Attorney, Agent, or Firm* — Ellen Plotkin

(57) ABSTRACT

A packaged product and a method for monitoring usage in a consumer test is reported herein. The packaged product includes a bottle having a container body with an open end and a closed end, the open end being formed with a neck and a mouth at a terminus of the neck. A flowable material is held within the container body. A monitoring unit immersed at least partially within the flowable material includes: (1) at least one support rod, the rod contacting the neck thereby inhibiting movement of the monitoring unit; (2) a logger device to sense and record motion of the bottle, the device including a circuit board fitted with at least one computer chip; (3) a retention unit arranged on the support rod inhibiting travel of the logger device relative to the support rod. According to the method of the invention, compliance to a test protocol can be certified through records extracted from the logger unit after evaluation is completed by the consumer.

7 Claims, 3 Drawing Sheets

U.S. PATENT DOCUMENTS

| | | | | |
|---|---|---|---|---|
| 4,763,816 | A | 8/1988 | Lee | |
| 4,828,149 | A | 5/1989 | Hester | |
| 4,939,705 | A | 7/1990 | Hamilton et al. | |
| 5,318,197 | A | 6/1994 | Martindale et al. | |
| 5,505,192 | A | 4/1996 | Samiotes et al. | |
| 5,505,349 | A * | 4/1996 | Peckels | 222/641 |
| 6,076,708 | A | 6/2000 | Ceccarelli et al. | |
| 6,249,717 | B1 | 6/2001 | Nicholson et al. | |
| 6,504,481 | B2 | 1/2003 | Teller | |
| 7,202,780 | B2 * | 4/2007 | Teller | 340/539.31 |
| 7,265,673 | B2 | 9/2007 | Teller | |
| 7,411,511 | B2 | 8/2008 | Kennish et al. | |
| 7,573,395 | B2 * | 8/2009 | Morrison et al. | 340/689 |
| 2002/0144914 | A1 | 10/2002 | Woskoski | |
| 2003/0089733 | A1 | 5/2003 | Cain et al. | |
| 2007/0080180 | A1 | 4/2007 | Ceccarelli et al. | |
| 2007/0194781 | A1 | 8/2007 | Zhitomirskiy | |
| 2007/0222619 | A1 | 9/2007 | Moran | |
| 2008/0114488 | A1 | 5/2008 | Mogadam | |
| 2008/0197836 | A1 | 8/2008 | Lee et al. | |

* cited by examiner

DEVICE AND METHOD FOR MONITORING CONSUMER TEST COMPLIANCE

BACKGROUND OF THE INVENTION

1. Field of the Invention

The invention concerns a device and method for monitoring adherence by a panelist to a protocol in a usage test.

2. The Related Art

There are essentially two ways to study consumer product usage habits. The first is to ask them what they do. Diary studies, survey and questionnaires can accomplish this at the end of a home usage test. The second is to use direct measures of behavior including video observation and motion tracking. Yet both kinds of methodologies have drawbacks.

Verbal reports are not always appropriate for studying habits. People are very often unable to report the aspects of their behavior. Furthermore, panelists tend to over-report their behavior. This may be unintentional or because of not having complied with instructions given may be intentional. Direct behavior measurement provides more accurate and detailed information. Other problems here arise. It only offers a snapshot of behavior in time. Also it is extremely expensive to collect (and then code) data. Moreover, the presence of an observer is likely to affect the very behavior they are there to observe.

Automatic monitoring devices have been reported in the literature. U.S. Pat. No. 6,504,481 B2 (Teller) reports a system for monitoring the dispensing of liquids, in particular beverages dispensed at a bar or restaurant. The monitoring device is attached to an exterior of a container and detects dispensing events by sensing tilt or motion of the container. U.S. Pat. No. 7,411,511 B2 (Kennish et al.) describes an interactive packaging system for monitoring the usage of personal hygiene products. In one embodiment, a liquid personal hygiene product is dispensed from a pump. A sensor is configured to detect movement of the pump as it dispenses product. U.S. Pat. No. 5,505,192 (Samiotes et al.) discloses an inhalator dosage monitoring system such as used by asthma suffers. WO 2008/058817 A1 (Unilever) discusses an article for monitoring and recording usage by a consumer of personal care products during a home use trial.

A problem with the known technology of automated devices in a liquid environment is that none operate unobtrusively. A great advantage would be a device present in an ordinary container for liquids camouflaged as to its presence. Consumers who are solicited to test the product should remain unaware of the monitor even when all liquid product has been consumed. Still further, it would be desirable to have a system wherein the monitor device can easily be recovered from a narrow-mouth container.

SUMMARY OF THE INVENTION

A packaged product with a compliance monitoring device is provided which includes:

(i) a bottle including a container body having an open end and a closed end, the open end being formed with a neck and a mouth at a terminus of the neck;

(ii) a flowable material held within the container body;

(iii) a monitoring unit within the container body and immersed at least partially within the flowable material, including:

(1) at least one support rod, the rod contacting the neck thereby inhibiting movement of the monitoring unit;

(2) a logger device to sense and record motion of the bottle, the device including a circuit board fitted with at least one computer chip; and (3) a retention unit arranged on the support rod inhibiting travel of the logger device relative to the support rod.

A method for monitoring usage by a test panelist of a flowable material contained in a bottle, the method including:

(A) providing a test panelist with a packaged product, the packaged product including:

(i) a bottle including a container body having an open end and a closed end, the open end being formed with a neck and a mouth at a terminus of the neck;

(ii) a flowable material held within the container body;

(iii) a monitoring unit within the container body and immersed at least partially within the flowable material including:

(1) at least one support rod, the rod contacting the neck thereby inhibiting movement of the monitoring unit;

(2) a logger device to sense and record motion of the bottle, the device including a circuit board fitted with at least one computer chip; and (3) a retention unit arranged on the support rod inhibiting travel of the logger device relative to the support rod;

(B) retrieving the packaged product from the test panelist and extracting the logger device from the bottle; and (C) downloading information stored on the computer chip to reveal usage of the packaged product.

BRIEF DESCRIPTION OF THE DRAWINGS

Features and advantages of the present invention will become more apparent from consideration of the drawing in which.

DETAILED DESCRIPTION OF THE INVENTION

Now we have found a method and device which allows us to transparently monitor compliance by a consumer to a protocol for usage evaluation at home for a test product. The monitoring unit of the present invention is not detectable within the bottle given to the panelist for evaluation. Anonymity is achieved by immersing the monitoring unit within a flowable material product inside the bottle. The monitoring unit is secured against movement by a member that contacts a neck of the bottle. Upon return of the empty container after the protocol, the monitoring unit easily slips outward through the neck. In this way the logger device held within the monitoring unit can be downloaded to recover motion and other data during the trial.

Figure 1:
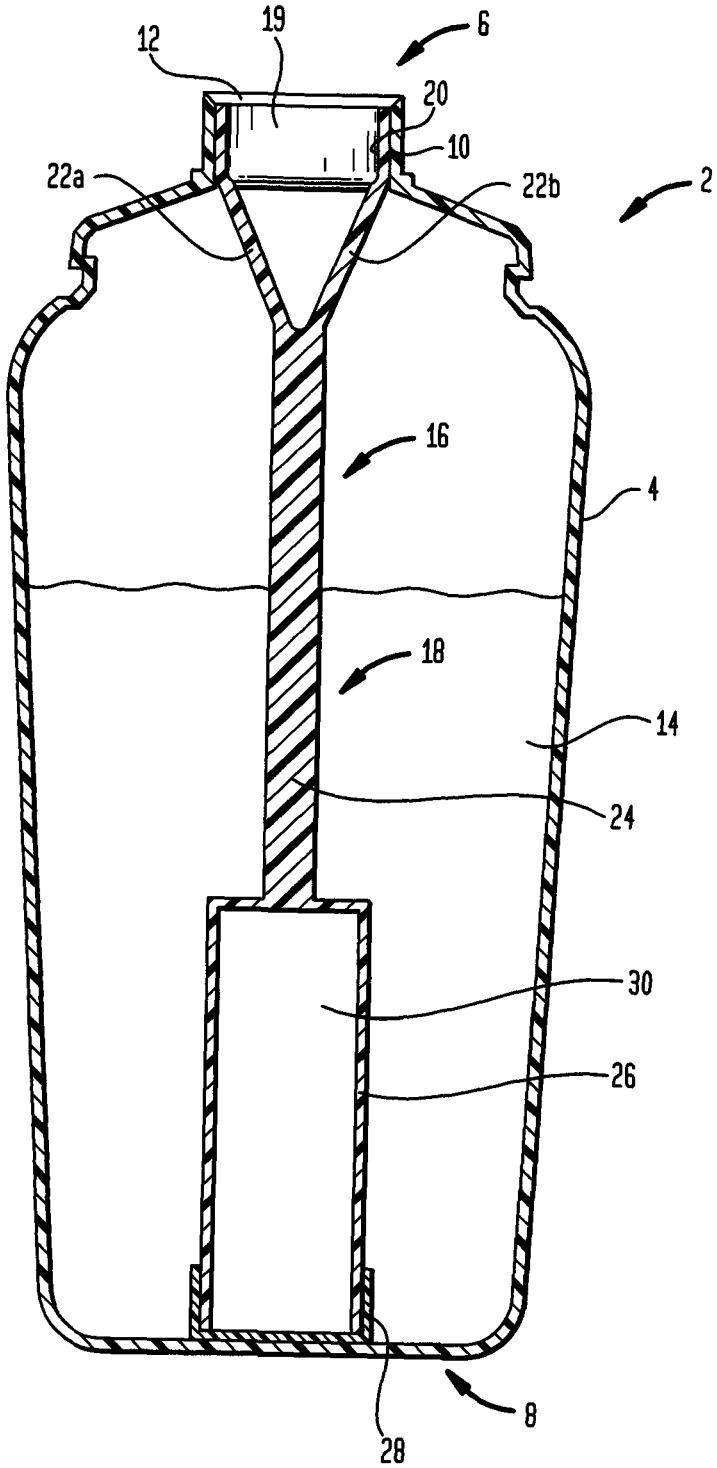
FIG. 1 is a cross-sectional view of a bottle fitted with a first embodiment of a monitoring unit according to the present invention.
Figure 2:
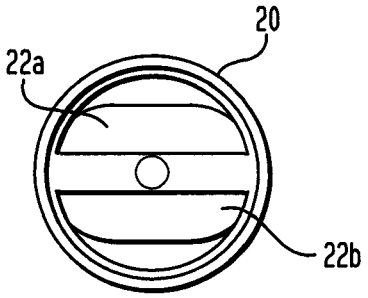
FIG. 2 is a top plan view of the first embodiment of the monitoring unit as shown in FIG. 1 outside of any bottle.

FIG. 1 illustrates a first embodiment of the present invention. A bottle 2 is shown in cross-section. It is formed with a container body 4 having an open end 6 and a closed end 8. A neck 10 with a mouth 12 at a terminus of the neck is located at the open end. A flowable material 14 is held within the container body. A monitoring unit 16 is at least partially immersed within the flowable material.

The monitoring unit has a support rod 18 contacting and being supported by neck 10.

The rod is formed with a nesting ring 20 having an outer wall supportably nestable against an inner wall of the neck and an aperture 19 allowing transfer of flowable material out of the container body.

A pair of arms 22*a*, 22*b* connect opposite sections of the nesting ring to a central bar 24.

On a terminus of the central bar opposite that of the arms is a retention cage 26 having a hollow central area and sealed with a cap 28. Within the retention cage is a logger 30 sufficiently sealed by cap 28 to prevent any flowable material entering the retention cage. The overall length of the monitoring unit is fashioned such that a top of cap 28 rests on an interior floor of bottle 2 while the nesting ring fits securely within the neck.

Figure 3:
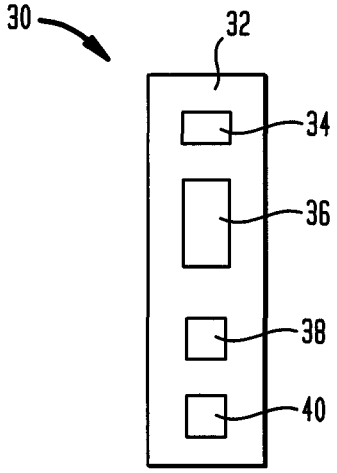
FIG. 3 is a schematic of a circuit board within the logger device.

FIG. 3 is a schematic view of the logger 30 with its shroud removed and revealing a circuit board 32. Wired to the board is a real time clock 34, an accelerometer 36 and a non-volatile memory chip 38. A battery 40 supplies power throughout the circuit board.

Figure 4:
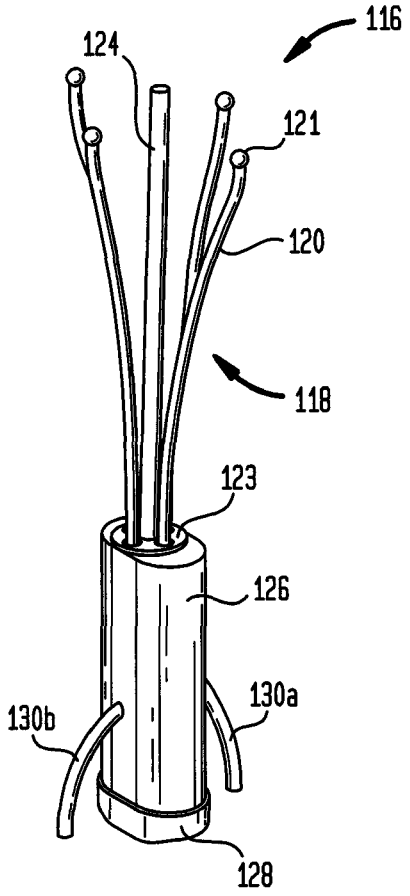
FIG. 4 is a perspective view of the second embodiment of a monitoring unit according to the present invention.

The logger is first connected to a computer and programmed to provide key operational parameters. These include start time for recording, recording frequency, and the duration of recording. While in the monitoring unit, the logger will check acceleration on each of the small x, y and z axes twice a second. It will initiate recording on a detected acceleration above a pre-set threshold. Then it will record the acceleration data in the three axes at a pre-specified frequency creating a record of a pre-determined time length. At the end of the record the logger will stop recording unless it is still experiencing above threshold acceleration. In such case, it will create another record. For each record the logger will register the date and time from its real time clock. Data is stored in the non-volatile memory chip so that it is protected from any loss of power due to battery failure. At the end of the consumer trial, the logger is retrieved from the product and data downloaded onto a computer. A logger suitable for the present invention is described in greater detail in WO 2008/058817, herein incorporated by reference FIG. 4 illustrates a second embodiment of a monitoring unit 116 according to the present invention. In this embodiment, the support rod 118 features a set of four equidistantly spaced flexible nesting wires 120 having bulbous terminal ends 121. All of the nesting wires 120 are supported by a plate 123. A central bar 124 projects upward from the plate and is arranged interior to all of the nesting wires. Unitarily molded with the plate, central bar and nesting wires is a retention cage 126. An interior of the retention cage is hollow to receive a logger. Flowable material is prevented from entering the retention cage by a cap 128 sealing an opening of the retention cage. A pair of stabilization wires 130*a*, 130*b* are unitarily molded with walls of the retention cage and project outwardly therefrom in opposite directions to one another. The function of the stabilizing wires is to prevent the monitoring unit from moving about in the container body.

Figure 5:
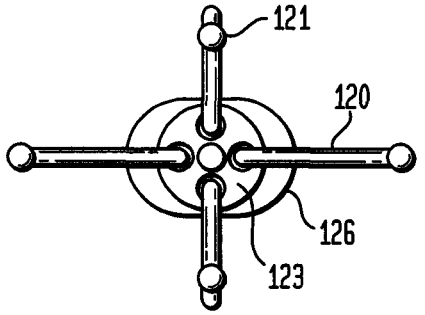
FIG. 5 is a top plan view of the second embodiment according to FIG. 4.

FIG. 5 illustrates a top down view of monitoring unit 116. The nesting wires 120 along their terminus portions and the bulbous terminal ends 121 rest against inner walls of the neck of the bottle to inhibit movement.

Figure 6:
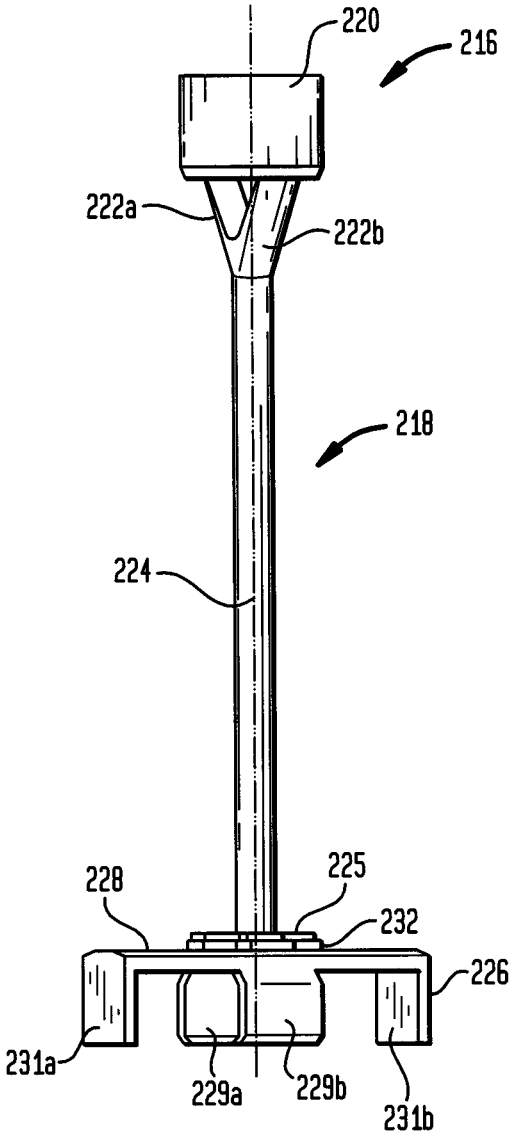
FIG. 6 is a perspective view of a third embodiment of a monitoring unit according to the present invention.

FIG. 6 illustrates a third embodiment of a monitoring unit 216. The unit includes a support rod 218 formed with a nesting ring 220. A pair of arms 222*a*, 222*b* connect opposite sections of the nesting ring to a central bar 224. A projection 225 shaped as a cross is unitarily molded at an end of the central bar distant from the end with the arms. A variety of shapes different from that of a cross may be utilized as the projection. For instance, a round, oval or any polygonal structure would be suitable as a projection. Separate from the combination of support rod, nesting ring, arms, central bar and projection is a retention cage 226 formed with a rectangular beam 228 with unitarily molded plastic clip members 229*a*, 229*b* and at opposite ends of the beam a pair of brackets 231*a*, 231*b*. A logger 230 is secured within the clip members and brackets. The beam 228 has a hollow receiving area 232 of a shape complementary to that of the projection 225.

Figure 7:
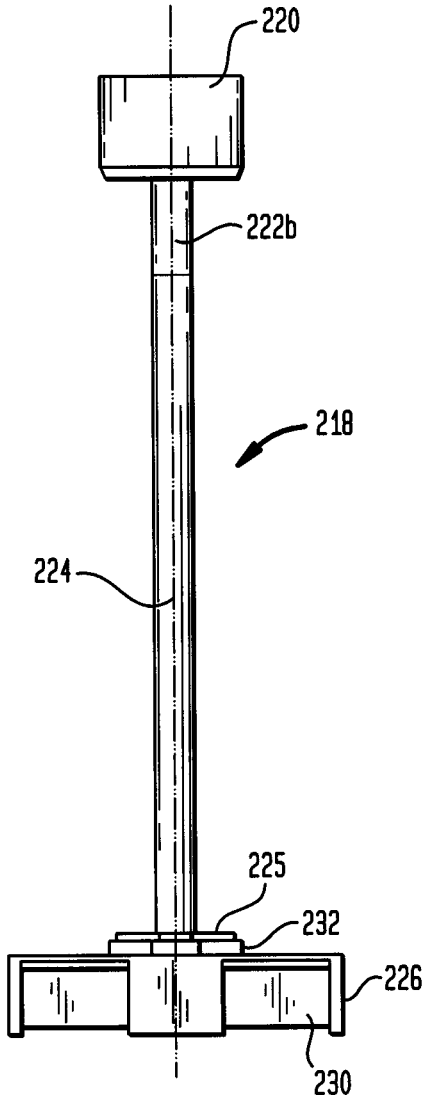
FIG. 7 is a side plan view of the third embodiment of the monitoring unit according to FIG. 6, and further depicting a logger device held within the cradle of the third embodiment.

FIG. 7 illustrates the third embodiment of the monitoring device with logger 230 clipped into place within the retention cage 226. In use, the retention cage fitted with logger is first placed into a bottle containing a test flowable material. Thereafter, the unitarily molded support rod, nesting rings, arms and center bar with projection is inserted through the neck of the bottle and immersed within the flowable material. Insertion is carefully arranged to cause projection 225 to be inserted within the hollow receiving area 232 of the retention cage.

Devices and the method of the present invention may be practiced with a variety of products that are in flowable material form. Particularly appropriate are home and personal care products such as skin creams/lotions, body wash, shampoos, hair conditioners, hair colorants, antiperspirants and mouthwashes.

A variety of different closures may be applied over the neck of the bottle. These may include screw-on caps, flip-top caps and pump dispensing heads with nozzles. Encompassed by this invention are not only upright standing bottles but also tottles. The latter are invert standing bottles wherein the cap rather than closed end of the container body is stood on a supporting shelf or other surface.

What is claimed is:

1. A packaged product comprising;

(i) a bottle including a container body having an open end and a closed end, the open end being formed with a neck and a mouth at a terminus of the neck;

(ii) a flowable material held within the container body;

(iii) a monitoring unit within the container body and immersed at least partially within the flowable material, the unit comprising;

(1) at least one support rod, said support rod comprising a nesting ring having a through going aperture allowing transfer of flowable material stored in the container body to exit the bottle; and said support rod further comprising at least two arms connected to the nesting ring and to a central bar;

the rod contacting the neck thereby inhibiting movement of the monitoring unit;

(2) a logger device adjacent the closed end to sense and record motion of the bottle, the device including a circuit board fitted with at least one computer chip; and (3) a retention unit arranged on the support rod inhibiting travel of the logger device relative to the support rod.

2. The packaged product according to claim 1 wherein the retention unit is a retention cage connected to the central bar at an end distant from the at least two arms.

3. The packaged product according to claim 2 wherein the retention cage has a hollow area for receiving the logger device and is fitted with a seal to prevent contact of the logger device with any flowable material.

4. The packaged product according to claim 1 wherein the support rod is separate from the retention unit.

5. The packaged product according to claim 4 wherein the support rod further Comprises a projection at an end of the central bar engageable with a complementary hollow area on the retention unit.

6. The packaged product according to claim 5 wherein the retention unit is a retention cage having clip members to retain the logger device.

7. The packaged product according to claim 1 wherein the circuit board of the logger device comprises a real time clock, an accelerometer, a non-volatile memory chip and a battery.

* * * * *